US011562705B2

(12) United States Patent
Cho

(10) Patent No.: US 11,562,705 B2
(45) Date of Patent: Jan. 24, 2023

(54) DISPLAY APPARATUS AND METHOD OF DRIVING THE SAME

(71) Applicant: Samsung Display Co., Ltd., Yongin-si (KR)

(72) Inventor: Seongheon Cho, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 182 days.

(21) Appl. No.: 16/831,408

(22) Filed: Mar. 26, 2020

(65) Prior Publication Data

US 2021/0035514 A1 Feb. 4, 2021

(30) Foreign Application Priority Data

Jul. 29, 2019 (KR) ..... 10-2019-0092023

(51) Int. Cl.
*G09G 3/36* (2006.01)
*G09G 3/3233* (2016.01)
*G09G 3/20* (2006.01)

(52) U.S. Cl.
CPC ..... *G09G 3/3607* (2013.01); *G09G 3/2007* (2013.01); *G09G 3/3233* (2013.01); *G09G 3/3648* (2013.01); *G09G 2310/0232* (2013.01); *G09G 2320/0233* (2013.01); *G09G 2320/0242* (2013.01); *G09G 2354/00* (2013.01)

(58) Field of Classification Search
None
See application file for complete search history.

(56) References Cited

U.S. PATENT DOCUMENTS

2002/0149598 A1* 10/2002 Greier ..... G09G 3/3611 345/589
2005/0141778 A1* 6/2005 Nakajima ..... H04N 1/62 382/254
2014/0077186 A1* 3/2014 Kim ..... H01L 51/52 257/40
2017/0199442 A1* 7/2017 Kim ..... G02B 26/0875
2017/0261656 A1* 9/2017 Kim ..... G02B 5/205
2018/0366061 A1 12/2018 Furukawa et al.
2019/0123112 A1* 4/2019 Lee ..... H01L 51/5284
2019/0205591 A1* 7/2019 Ban ..... G06V 40/1365
2019/0293976 A1* 9/2019 Cheng ..... H04M 1/0266
2020/0225828 A1* 7/2020 Jeong ..... G09G 3/32
2020/0394983 A1* 12/2020 Huang ..... G09G 3/3225

FOREIGN PATENT DOCUMENTS

KR 10-2018-0023101 A 3/2018
KR 10-2018-0050473 A 5/2018

* cited by examiner

*Primary Examiner* — Parul H Gupta
(74) *Attorney, Agent, or Firm* — Lewis Roca Rothgerber Christie LLP

(57) ABSTRACT

A display apparatus includes: a sensor substrate including a first area and a second area; a plurality of sensors at the first area and not at the second area; a display panel on the sensor substrate, the display panel including a first display area corresponding to the first area, and a second display area corresponding to the second area, the first display area including a pixel area and a non-pixel area; at least one subpixel at the pixel area and no subpixels at the non-pixel area; and a display panel driver to control a driving signal of the first display area and a driving signal of the second display area according to a ratio between the pixel area of the first display area and the non-pixel area of the first display area.

20 Claims, 13 Drawing Sheets

DISPLAY APPARATUS AND METHOD OF DRIVING THE SAME

CROSS-REFERENCE TO RELATED APPLICATION

This application claims priority to and the benefit of Korean Patent Application No. 10-2019-0092023, filed on Jul. 29, 2019 in the Korean Intellectual Property Office KIPO, the entire content of which is herein incorporated by reference.

BACKGROUND

1. Field

Aspects of one or more exemplary embodiments of the present disclosure relate to a display apparatus and a method of driving the display apparatus. More particularly, aspects of one or more exemplary embodiments of the present disclosure relate to a display apparatus including a plurality of sensors to sense a user and a method of driving the display apparatus.

2. Description of the Related Art

Generally, a display apparatus includes a display panel and a display panel driver. The display panel includes a plurality of gate lines, a plurality of data lines, a plurality of emission lines, and a plurality of pixels. The display panel driver includes a gate driver, a data driver, an emission driver, and a driving controller. The gate driver outputs gate signals to the gate lines. The data driver outputs data voltages to the data lines. The emission driver outputs emission signals to the emission lines. The driving controller controls the gate driver, the data driver, and the emission driver.

The display apparatus may further include sensors to sense a position of a user, an appearance of the user, and/or the like to operate an additional function. When a sensor substrate including the sensors is disposed under the display panel, a transmission area may be formed at (e.g., in or on) the display panel for the sensors to sense the user. However, due to the transmission area, luminance of an image displayed on the display panel may not be uniformly generated.

The above information disclosed in this Background section is for enhancement of understanding of the background of the disclosure, and therefore, it may contain information that does not constitute prior art.

SUMMARY

Aspects of one or more exemplary embodiments of the present disclosure are directed to a data apparatus for compensating for non-uniformity in luminance of a display panel of a display apparatus including a sensor to improve or enhance a display quality of the display panel.

Aspects of one or more exemplary embodiments of the present disclosure are directed to a method of driving the display apparatus.

According to an exemplary embodiment of the present disclosure, a display apparatus includes: a sensor substrate including a first area and a second area; a plurality of sensors at the first area and not at the second area; a display panel on the sensor substrate, the display panel including a first display area corresponding to the first area, and a second display area corresponding to the second area, the first display area including a pixel area and a non-pixel area; at least one subpixel at the pixel area and no subpixels at the non-pixel area; and a display panel driver configured to control a driving signal of the first display area and a driving signal of the second display area according to a ratio between the pixel area of the first display area and the non-pixel area of the first display area.

In an exemplary embodiment, the display panel driver may be configured to generate: a minimum data voltage corresponding to a minimum grayscale value of input image data corresponding to the first display area; a maximum data voltage corresponding to a maximum grayscale value of the input image data corresponding to the first display area; a minimum data voltage corresponding to a minimum grayscale value of the input image data corresponding to the second display area; and a maximum data voltage corresponding to a maximum grayscale value of the input image data corresponding to the second display area. A difference between the maximum data voltage and the minimum data voltage of the input image data corresponding to the first display area may be greater than a difference between the maximum data voltage and the minimum data voltage of the input image data corresponding to the second display area.

In an exemplary embodiment, when a ratio between the pixel area at the first display area and a sum of the pixel area and the non-pixel area at the first display area is 1/N, the difference between the maximum data voltage and the minimum data voltage of the input image data corresponding to the first display area may be greater than the difference between the maximum data voltage and the minimum data voltage of the input image data corresponding to the second display area by N times.

In an exemplary embodiment, the display panel driver may be configured to provide: a first power voltage to a subpixel circuit of the first display area; and a second power voltage to a subpixel circuit of the second display area, and the first power voltage may be greater than the second power voltage.

In an exemplary embodiment, when a ratio between the pixel area at the first display area and a sum of the pixel area and the non-pixel area at the first display area is 1/N, the first power voltage may be greater than the second power voltage by N times.

In an exemplary embodiment, the subpixel may include an organic light emitting diode, the subpixel may be configured to receive a data write gate signal, a data initialization gate signal, an organic light emitting diode initialization signal, a data voltage, and an emission signal, and the organic light emitting diode of the subpixel may be configured to emit light corresponding to a level of the data voltage to display an image.

In an exemplary embodiment, the subpixel may further include: a first pixel switching element including a control electrode connected to a first node, an input electrode connected to a second node, and an output electrode connected to a third node; a second pixel switching element including a control electrode to receive the data write gate signal, an input electrode to receive the data voltage, and an output electrode connected to the second node; a third pixel switching element including a control electrode to receive the data write gate signal, an input electrode connected to the first node, and an output electrode connected to the third node; a fourth pixel switching element including a control electrode to receive the data initialization gate signal, an input electrode to receive an initialization voltage, and an output electrode connected to the first node; a fifth pixel switching element including a control electrode to receive the emission signal, an input electrode to receive a high power voltage, and an output electrode connected to the second node; a sixth pixel switching element including a control electrode to receive the emission signal, an input electrode connected to the third node, and an output electrode connected to an anode electrode of the organic light emitting diode; a seventh pixel switching element including a control electrode to receive the organic light emitting diode initialization gate signal, an input electrode to receive the initialization voltage, and an output electrode connected to the anode electrode of the organic light emitting diode; and a storage capacitor including a first electrode to receive the high power voltage, and a second electrode connected to the first node, and the organic light emitting diode may include the anode electrode, and a cathode electrode to receive a low power voltage.

In an exemplary embodiment, the input electrode of the fifth pixel switching element of the subpixel at the first display area may be configured to receive the first power voltage, another subpixel may be at the second display area, and an input electrode of a fifth pixel switching element of the other subpixel at the second display area may be configured to receive the second power voltage.

In an exemplary embodiment, the display panel driver may be configured to provide a first normal image frame according to input image data to the first display area, and the display panel driver may be configured to provide a second normal image frame according to the input image data, and a black frame image to the second display area.

In an exemplary embodiment, when a ratio between the pixel area of the first display area and a sum of the pixel area and the non-pixel area of the first display area is x:y, a ratio between a number of the second normal frames of the second display area and a number of the first normal frames of the first display area may be x:y.

In an exemplary embodiment, the plurality of sensors may include an infrared sensor.

In an exemplary embodiment, the plurality of the sensors may be configured to recognize a face of a user.

In an exemplary embodiment, a size of the pixel area at the first display area may be the same as a size of the non-pixel area at the first display area.

In an exemplary embodiment, the pixel area at the first display area may include a plurality of pixel areas, and each of the plurality of pixel areas may include a single subpixel.

In an exemplary embodiment, the pixel area at the first display area may include a plurality of pixel areas, and each of the pixel areas may include a single pixel, the single pixel including a plurality of subpixels.

In an exemplary embodiment, the non-pixel area may include a plurality of non-pixel areas, and each single sensor from among the plurality of sensors may overlap with a corresponding one of the non-pixel areas.

In an exemplary embodiment, the non-pixel area may include a plurality of non-pixel areas, and each single sensor from among the plurality of sensors may overlap with a plurality of corresponding ones of the non-pixel areas.

According to an exemplary embodiment of the present disclosure, a method of driving a display apparatus, includes: sensing a user using a sensor substrate, the sensor substrate including a first area, a second area, and a plurality of sensors at the first area and not at the second area; providing a driving signal to a first display area of a display panel corresponding to the first area, the first display area including a pixel area, a non-pixel area, and at least one subpixel at the pixel area and no subpixels at the non-pixel area; and providing a driving signal to a second display area of the display panel corresponding to the second area. A display panel driver is configured to control the driving signal of the first display area and the driving signal of the second display area according to a ratio between the pixel area of the first display area and the non-pixel area of the first display area.

In an exemplary embodiment, the display panel driver may be configured to generate: a minimum data voltage corresponding to a minimum grayscale value of input image data corresponding to the first display area; a maximum data voltage corresponding to a maximum grayscale value of the input image data corresponding to the first display area; a minimum data voltage corresponding to a minimum grayscale value of the input image data corresponding to the second display area; and a maximum data voltage corresponding to a maximum grayscale value of the input image data corresponding to the second display area. A difference between the maximum data voltage and the minimum data voltage of the input image data corresponding to the first display area may be greater than a difference between the maximum data voltage and the minimum data voltage of the input image data corresponding to the second display area.

In an exemplary embodiment, the display panel driver may be configured to provide: a first power voltage to a subpixel circuit of the first display area; and a second power voltage to a subpixel circuit of the second display area, and the first power voltage may be greater than the second power voltage.

According to one or more exemplary embodiments of the display apparatus and the method of driving the display apparatus, a difference between the luminance of a first display area of the display panel corresponding to a first area of the sensor substrate and the luminance of a second display area of the display panel corresponding to a second area of the sensor substrate may be reduced, so that the display quality of the display panel may be improved or enhanced.

BRIEF DESCRIPTION OF THE DRAWINGS

The above and other aspects and features of the present disclosure will become more apparent to those skilled in the art from the following detailed description of the illustrative, non-limiting exemplary embodiments thereof with reference to the accompanying drawings, in which.

DETAILED DESCRIPTION

Figure 1:
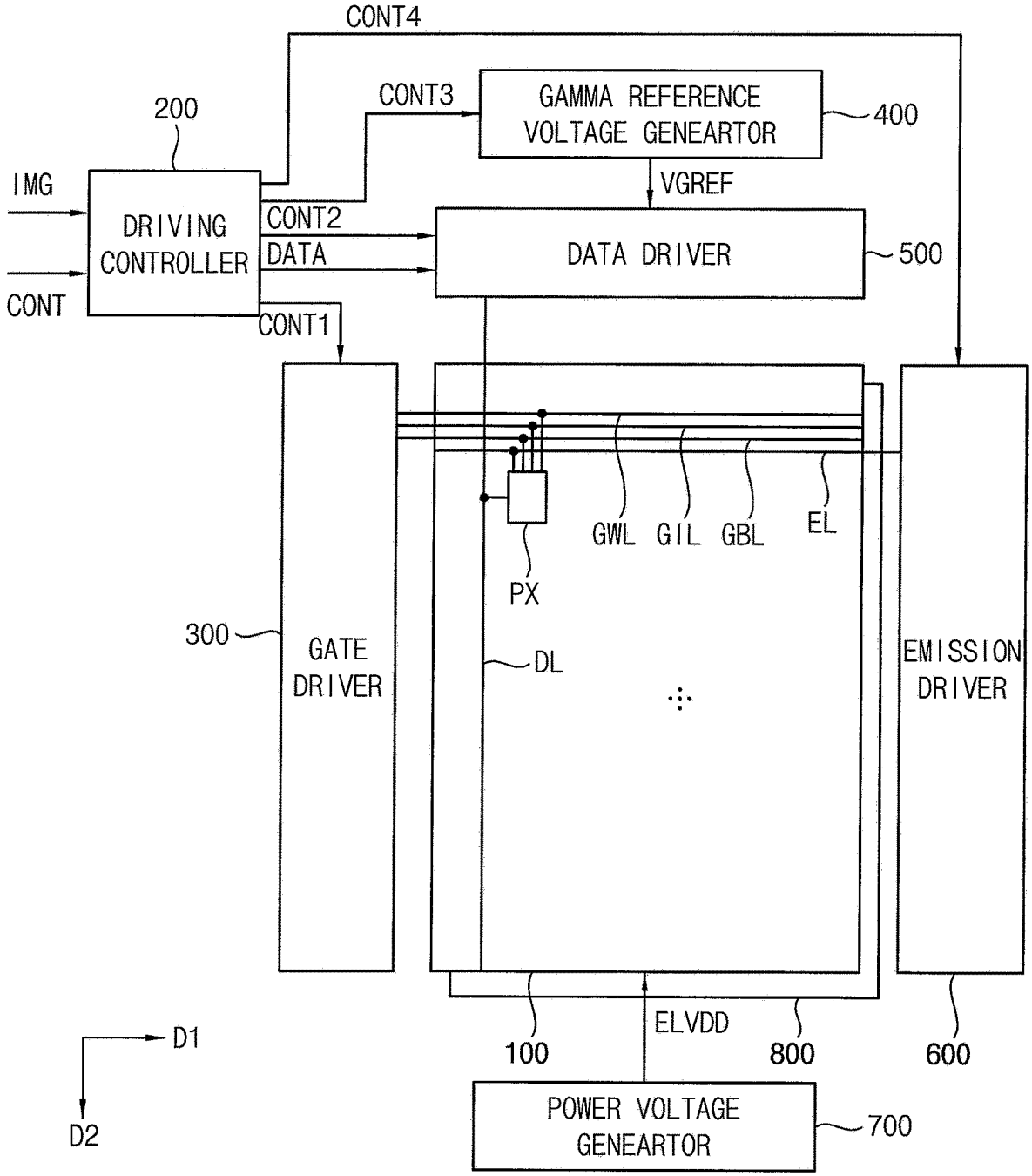
FIG. 1 is a block diagram illustrating a display apparatus according to an exemplary embodiment of the present disclosure.

Hereinafter, example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the disclosure to those skilled in the art. Accordingly, processes, elements, and techniques that are not necessary to those having ordinary skill in the art for a complete understanding of the aspects and features of the disclosure may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the disclosure. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the disclosure refers to "one or more embodiments of the disclosure." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display apparatus according to an exemplary embodiment of the present disclosure.

Referring to FIG. 1, the display apparatus includes a display panel 100 and a display panel driver. The display panel driver includes a driving controller 200, a gate driver 300, a gamma reference voltage generator 400, a data driver 500, and an emission driver 600. The display panel driver may further include a power voltage generator 700. The display apparatus may further include a sensor substrate 800.

In some embodiments, two or more of the components of the display panel driver may be integrally formed with each other. For example, the driving controller 200 and the data driver 500 may be integrally formed with each other. In another example, the driving controller 200, the gamma reference voltage generator 400, and the data driver 500 may be integrally formed with each other. In yet another example, the driving controller 200, the gate driver 300, the gamma reference voltage generator 400, and the data driver 500 may be integrally formed with each other. In still another example, the driving controller 200, the gate driver 300, the gamma reference voltage generator 400, the data driver 500, and the emission driver 600 may be integrally formed with each other. In still yet another example, the driving controller 200, the gate driver 300, the gamma reference voltage generator 400, the data driver 500, the emission driver 600, and the power voltage generator 700 may be integrally formed with each other.

The display panel 100 includes a plurality of gate lines GWL, GIL, and GBL, a plurality of data lines DL, a plurality of emission lines EL, and a plurality of pixels PX electrically connected to the gate lines GWL, GIL, and GBL, the data lines DL, and the emission lines EL. The gate lines GWL, GIL, and GBL, and the emission lines EL extend in a first direction D1, and the data lines DL extend in a second direction D2 crossing the first direction D1.

The driving controller 200 receives input image data IMG and an input control signal CONT from an external apparatus (e.g., a host device). For example, the input image data IMG may include red image data, green image data, and blue image data. In some embodiments, the input image data IMG may include white image data. In another example, the input image data IMG may include magenta image data, cyan image data, and yellow image data. However, the present disclosure is not limited thereto, and the input image data IMG may include any suitable kinds of image data for driving the pixels PX as would be known to those skilled in the art. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include, for example, a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include, for example, a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals for driving the gate lines GWL, GIL, and GBL in response to the first control signal CONT1 received from the driving controller 200. The gate driver 300 may output (e.g., sequentially output) the gate signals to the gate lines GWL, GIL, and GBL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level (e.g., a voltage level) of the data signal DATA.

In an exemplary embodiment, the gamma reference voltage generator 400 may be disposed at (e.g., in or on) the driving controller 200, or at (e.g., in or on) the data driver 500. For example, the gamma reference voltage generator 400 may be integrally formed with the driving controller 200, or may be integrally formed with the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages (e.g., data signals) having a suitable kind of voltage (e.g., an analog voltage) using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The power voltage generator 700 may generate a power voltage for operating the display panel 100 and the display panel driver. For example, the power voltage generator 700 may output a power voltage ELVDD to a subpixel circuit of the display panel 100.

The sensor substrate 800 may be disposed under (e.g., underneath) the display panel 100. The sensor substrate 800 may include a plurality of sensors to sense a user. For example, the sensors may be proximity sensors to sense a proximity of the user. For example, the sensors may be gesture sensors to sense a gesture of the user. For example, the sensors may be fingerprint sensors to sense a fingerprint of the user. For example, the sensors may be iris recognition sensors to sense an iris of the user. For example, the sensors may be face recognition sensors to sense a face of the user.

Figure 2:
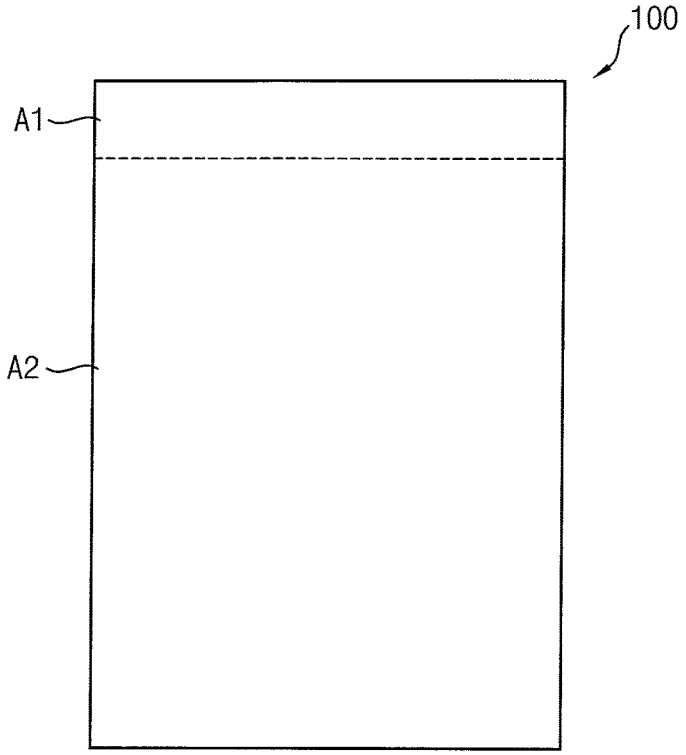
FIG. 2 is a conceptual diagram illustrating a plan view of a display panel of FIG. 1.
Figure 3:
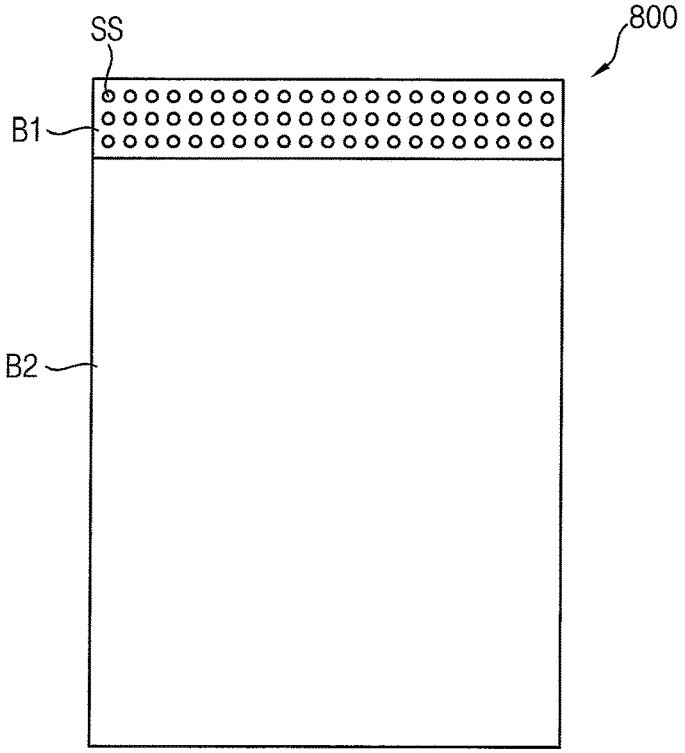
FIG. 3 is a conceptual diagram illustrating a plan view of a sensor substrate of FIG. 1.

FIG. 2 is a conceptual diagram illustrating a plan view of the display panel 100 of FIG. 1. FIG. 3 is a conceptual diagram illustrating a plan view of the sensor substrate 800 of FIG. 1. As used herein, a plan view may refer to a view from a plane that is parallel to or substantially parallel to a top surface of the relevant component, layer, device, or apparatus (e.g., the display apparatus).

Referring to FIGS. 1 to 3, the display panel 100 may include a first display area A1 and a second display area A2. The sensor substrate 800 may include a first area B1 and a second area B2.

A plurality of sensors SS may be disposed at (e.g., in or on) the first area B1 of the sensor substrate 800. Although the sensors are illustrated in FIG. 3 as being arranged in three rows and twenty one columns at (e.g., in or on) the first area B1, the present disclosure is not limited to the number and/or arrangement of the sensors SS. In addition, unlike the sensors SS in FIG. 3, the sensors at (e.g., in or on) a first row and the sensors at (e.g., in or on) a second row may be alternately disposed with each other (e.g., see FIG. 4A).

For example, the sensors SS may be infrared sensors. For example, the sensors SS may recognize a face of the user.

The sensors SS may not be disposed at (e.g., in or on) the second area B2 of the sensor substrate 800.

The first display area A1 may correspond to the first area B1 of the sensor substrate 800. For example, the first display area A1 may overlap with the first area B1 of the sensor substrate 800.

The second display area A2 may correspond to the second area B2 of the sensor substrate 800. For example, the second display area A2 may overlap with the second area B2 of the sensor substrate 800.

Figure 4A:
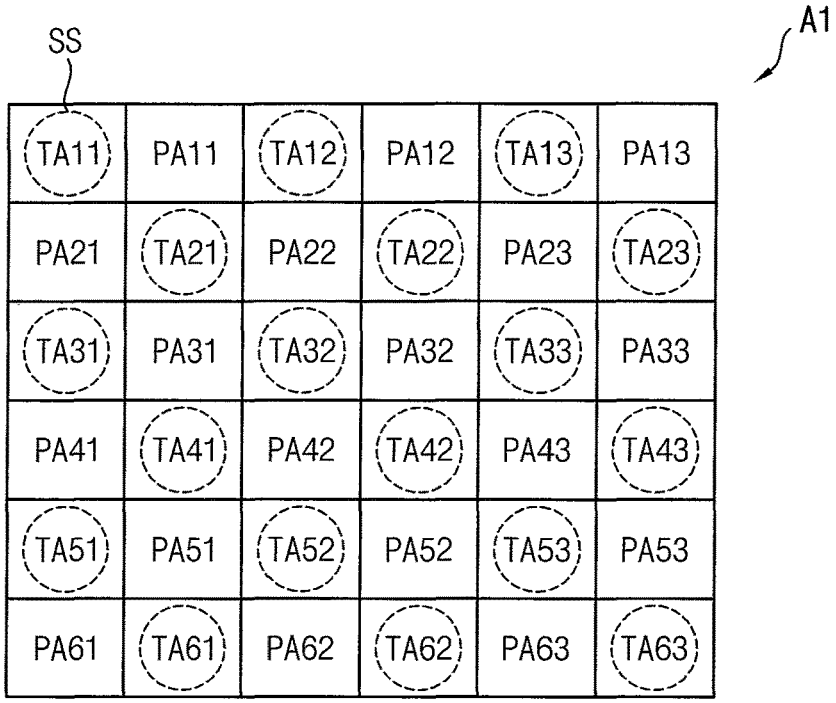
FIG. 4A is a conceptual diagram illustrating an example of a position relationship between a first display area of FIG. 2 and a sensor of FIG. 3.

FIG. 4A is a conceptual diagram illustrating an example of a position relationship between the first display area A1 of FIG. 2 and the sensors SS of FIG. 3.

Referring to FIGS. 1 to 4A, the first display area A1 may include a pixel area PA (e.g., PA11, PA12, PA13, . . . , PA63) and a non-pixel area TA (e.g., TA11, TA12, TA13, . . . , TA63). At least one subpixel may be disposed at (e.g., in or on) the pixel area PA (e.g., at each pixel area PA). For example, in FIG. 4A, one subpixel may be disposed at (e.g., in or on) the pixel area PA (e.g., at each pixel area PA). In another example, one pixel may be disposed at (e.g., in or on) the pixel area PA (e.g., at each pixel area PA). The pixel may include a plurality of subpixels (e.g. a plurality of RGB subpixels, a plurality of RGBW subpixels, a plurality of RGBG subpixels, and/or the like).

For example, a size of the pixel area PA at (e.g., in or on) the first display area A1 may be the same or substantially the same as a size of the non-pixel area TA at (e.g., in or on) the first display area A1.

The subpixel or the pixel may not be disposed at (e.g., in or on) the non-pixel area TA.

The pixel area PA may display an image based on the input image data IMG. The non-pixel area TA has a high transmittance for a sensing operation of the sensor SS.

For example, the pixel area PA and the non-pixel area TA may form a checker board pattern. For example, a plurality of non-pixel areas TA11, TA12, and TA13 and a plurality of pixel areas PA11, PA12 and PA13, are alternately disposed with each other at (e.g., in or on) a first row of the first display area A1. A plurality of pixel areas PA21, PA22, and PA23 and a plurality of non-pixel areas TA21, TA22, and TA23 are alternately disposed with each other at (e.g., in or on) a second row of the first display area A1. A plurality of non-pixel areas TA31, TA32, and TA33 and a plurality of pixel areas PA31, PA32, and PA33 are alternately disposed with each other at (e.g., in or on) a third row of the first display area A1. A plurality of pixel areas PA41, PA42, and PA43 and a plurality of non-pixel areas TA41, TA42, and TA43 are alternately disposed with each other at (e.g., in or on) a fourth row of the first display area A1. Similarly, a plurality of pixel areas and non-pixel areas may be alternately disposed with each other at (e.g., in or on) a fifth row of the first display area A1, a sixth row of the first display area A1, and/or the like).

Although the pixel areas PA and the non-pixel areas TA are illustrated in FIG. 4A in six rows and six columns, the present disclosure is not limited to the number of the pixel areas PA, the number of the non-pixel areas TA, and/or the total number of the pixel areas PA and the non-pixel areas TA.

The sensors SS may be disposed at (e.g., in or on) the non-pixel areas TA. For example, as shown in FIG. 4A, a single sensor SS may be disposed at (e.g., in or on) a single non-pixel area TA, such that each of the non-pixel areas TA may include a single one of the sensors SS.

In FIG. 4A, the number of the pixel areas PA may be same or substantially the same as the number of the non-pixel areas TA at (e.g., in or on) the first display area A1. For example, if the first display area A1 includes the pixel area PA and the non-pixel area TA (e.g., includes only the pixel area PA and the non-pixel area TA), a ratio between the pixel area PA and the non-pixel area TA at (e.g., in or on) the first display area A1 may be 1:1. Further, in this case, a ratio between the pixel area PA at (e.g., in or on) the first display area A1 and the sum of the pixel area PA and the non-pixel area TA at (e.g., in or on) the first display area A1 may be ½.

The second display area A2 may correspond to the second area B2 at (e.g., in or on) which the sensor SS is not disposed so that the second display area A2 may include the pixel area PA (e.g., include only the pixel areas PA) without the non-pixel areas TA.

For example, if the first display area A1 includes the pixel area PA and the non-pixel area TA (e.g., includes only the pixel area PA and the non-pixel area TA), and the ratio between the pixel area PA and the non-pixel area TA at (e.g., in or on) the first display area A1 is 1:1, the number of the pixel areas PA of the first display area A1 for a unit area (e.g., a particular area of the first display area A1 having a size) may be half of the number of the pixel areas PA of the second display area A2 for the unit area (e.g., a particular area of the second display area A2 having the same or substantially the same size as that of the particular area of the first display area A1). Thus, when the first display area A1 and the second display area A2 are driven by a same driving signal, the luminance of the first display area A1 may be half of the luminance of the second display area A2.

Figure 4B:
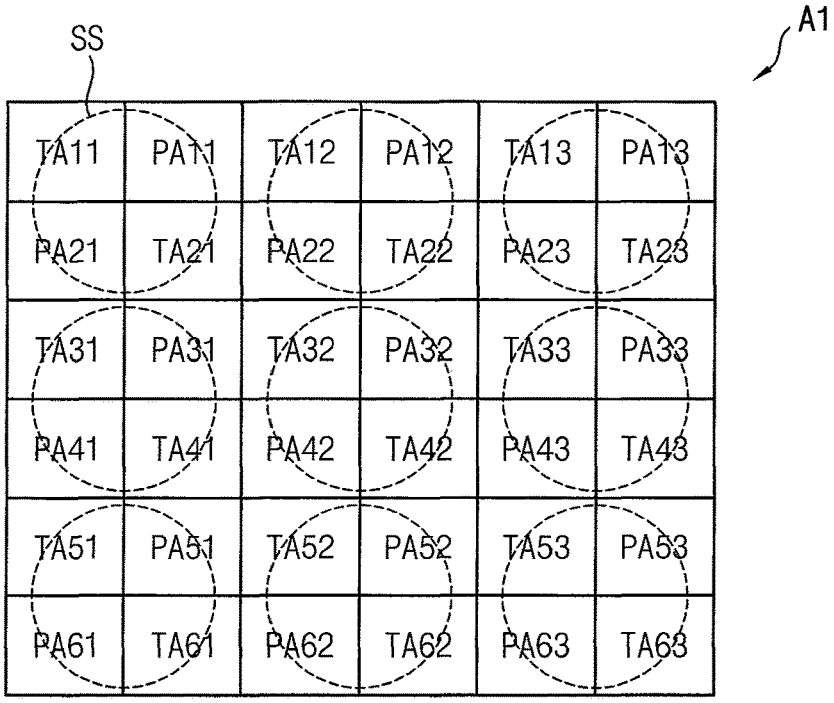
FIG. 4B is a conceptual diagram illustrating an example of a position relationship between the first display area of FIG. 2 and the sensor of FIG. 3.

FIG. 4B is a conceptual diagram illustrating an example of a position relationship between the first display area A1 of FIG. 2 and the sensors SS of FIG. 3.

Referring to FIGS. 1 to 3 and 4B, the first display area A1 may include a pixel area PA and a non-pixel area TA. At least one subpixel may be disposed at (e.g., in or on) the pixel area PA (e.g., at each of the pixel areas PA). In another example, at least one pixel may be disposed at (e.g., in or on) the pixel area PA (e.g., at each of the pixel areas PA). The subpixel or the pixel may not be disposed at (e.g., in or on) the non-pixel area TA (e.g., at each of the non-pixel areas TA).

The pixel area PA may display an image based on the input image data IMG. The non-pixel area TA has a high transmittance for a sensing operation of the sensor SS.

As shown in FIG. 4B, a single sensor SS may be disposed at (e.g., in or on) a plurality of non-pixel areas TA. For example, the single sensor SS may be disposed to correspond with four areas including two pixel areas PA and two non-pixel areas TA in two rows and two columns. In this case, the sensor SS may sense the user through the plurality of the non-pixel areas (e.g. TA11 and TA21).

Figure 5:
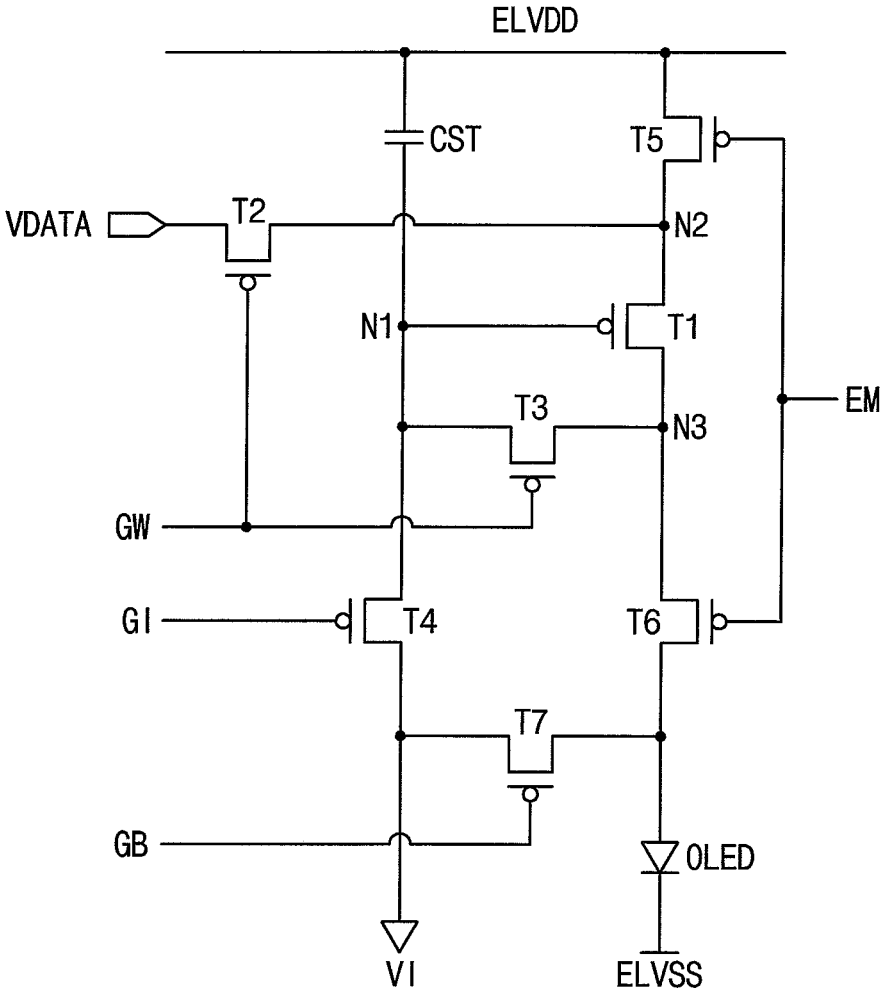
FIG. 5 is a circuit diagram illustrating a subpixel of the display panel of FIG. 1.
Figure 6:
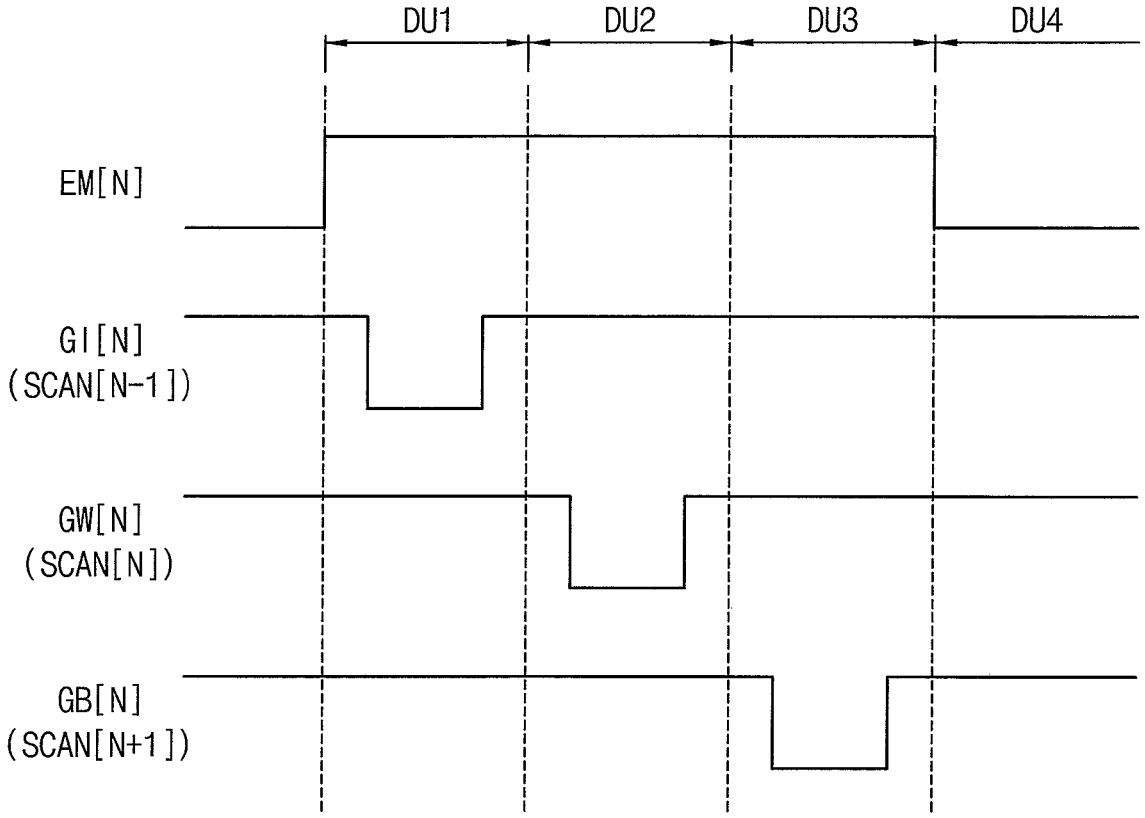
FIG. 6 is a timing diagram illustrating input signals applied to the subpixel of FIG. 5.

FIG. 5 is a circuit diagram illustrating a subpixel of the display panel 100 of FIG. 1. FIG. 6 is a timing diagram illustrating input signals applied to the subpixel of FIG. 5.

Referring to FIGS. 1 to 6, the display panel 100 includes a plurality of the subpixels. Each subpixel includes an organic light emitting diode OLED.

The subpixels receive a data write gate signal GW, a data initialization gate signal GI, an organic light emitting diode initialization signal GB, the data voltage (e.g., a data signal)

VDATA, and the emission signal EM. The organic light emitting diodes OLED of the subpixels emit light corresponding to the level (e.g., the voltage level) of the data voltage VDATA to display the image.

At least one of the subpixels may include first to seventh pixel switching elements (e.g., first to seventh pixel switches or first to seventh pixel switching transistors) T1 to T7, a storage capacitor CST, and the organic light emitting diode OLED.

The first pixel switching element T1 includes a control electrode connected to a first node N1, an input electrode connected to a second node N2, and an output electrode connected to a third node N3.

For example, the first pixel switching element T1 may be a P-type thin film transistor. In this case, the control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the data write gate signal GW is applied, an input electrode to which the data voltage VDATA is applied, and an output electrode connected to the second node N2.

For example, the second pixel switching element T2 may be a P-type thin film transistor. In this case, the control electrode of the second pixel switching element T2 may be a gate electrode, the input electrode of the second pixel switching element T2 may be a source electrode, and the output electrode of the second pixel switching element T2 may be a drain electrode.

The third pixel switching element T3 includes a control electrode to which the data write gate signal GW is applied, an input electrode connected to the first node N1, and an output electrode connected to the third node N3.

For example, the third pixel switching element T3 may be a P-type thin film transistor. In this case, the control electrode of the third pixel switching element T3 may be a gate electrode, the input electrode of the third pixel switching element T3 may be a source electrode, and the output electrode of the third pixel switching element T3 may be a drain electrode.

The fourth pixel switching element T4 includes a control electrode to which the data initialization gate signal GI is applied, an input electrode to which an initialization voltage VI is applied, and an output electrode connected to the first node N1.

For example, the fourth pixel switching element T4 may be a P-type thin film transistor. In this case, the control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which a high power voltage ELVDD is applied, and an output electrode connected to the second node N2.

For example, the fifth pixel switching element T5 may be a P-type thin film transistor. In this case, the control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, and an output electrode connected to an anode electrode of the organic light emitting diode OLED.

For example, the sixth pixel switching element T6 may be a P-type thin film transistor. In this case, the control electrode of the sixth pixel switching element T6 may be a gate electrode, the input electrode of the sixth pixel switching element T6 may be a source electrode, and the output electrode of the sixth pixel switching element T6 may be a drain electrode.

The seventh pixel switching element T7 includes a control electrode to which the organic light emitting diode initialization gate signal GB is applied, an input electrode to which the initialization voltage VI is applied, and an output electrode connected to the anode electrode of the organic light emitting diode OLED.

For example, the seventh pixel switching element T7 may be a P-type thin film transistor. In this case, the control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied, and a second electrode connected to the first node N1.

The organic light emitting diode OLED includes the anode electrode, and a cathode electrode to which a low power voltage ELVSS is applied.

In FIG. 6, during a first duration DU1, the first node N1 and the storage capacitor CST are initialized in response to the data initialization gate signal GI. During a second duration DU2, a threshold voltage (VTH) of the first pixel switching element T1 is compensated, and the data voltage VDATA of which the threshold voltage (VTH) is compensated is written to the first node N1 in response to the data write gate signal GW. During a third duration DU3, the anode electrode of the organic light emitting diode OLED is initialized in response to the organic light emitting diode initialization gate signal GB. During a fourth duration DU4, the organic light emitting diode OLED emits light in response to the emission signal EM so that the display panel 100 displays the image.

In more detail, during the first duration DU1, the data initialization gate signal GI may have an active level. For example, the active level of the data initialization gate signal GI may be a low level. When the data initialization gate signal GI has the active level, the fourth pixel switching element T4 is turned on so that the initialization voltage VI may be applied to the first node N1. The data initialization gate signal GI[N] of a present stage may be a scan signal SCAN[N-1] of a previous stage.

During the second duration DU2, the data write gate signal GW may have an active level. For example, the active level of the data write gate signal GW may be a low level. When the data write gate signal GW has the active level, the second pixel switching element T2 and the third pixel switching element T3 are turned on. In addition, the first pixel switching element T1 is turned on in response to the initialization voltage VI. The data write gate signal GW[N] of the present stage may be a scan signal SCAN[N] of the present stage.

A voltage, which is a difference between the data voltage VDATA and an absolute value |VTH| of the threshold voltage (VTH) of the first pixel switching element T1 (e.g., a subtraction of the absolute value |VTH| of the threshold voltage (VTH) of the first pixel switching element T1 from the data voltage VDATA), may be charged at the first node N1 through a path generated by the first to third pixel switching elements T1, T2 and T3.

During the third duration DU3, the organic light emitting diode initialization signal GB may have an active level. For example, the active level of the organic light emitting diode initialization signal GB may be a low level. When the organic light emitting diode initialization signal GB has the active level, the seventh pixel switching element T7 is turned on so that the initialization voltage VI may be applied to the anode electrode of the organic light emitting diode OLED. The organic light emitting diode initialization signal GB[N] of the present stage may be a scan signal SCAN[N+1] of a next stage.

Although the active timing of the organic light emitting diode initialization gate signal GB is shown in FIG. 6 to be different from the active timing of the data write gate signal GW according to the present exemplary embodiment, in another embodiment, the active timing of the organic light emitting diode initialization gate signal GB may be same or substantially the same as the active timing of the data write gate signal GW. In this case, the organic light emitting diode initialization signal GB[N] of the present stage may be the scan signal SCAN[N] of the present stage.

During the fourth duration DU4, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1, and the sixth pixel switching element T6 to drive the organic light emitting diode OLED. An intensity of the driving current may be determined according to (e.g., determined by) the level (e.g., the voltage level) of the data voltage VDATA. A luminance of the organic light emitting diode OLED is determined by the intensity of the driving current. For example, a driving current ISD that flows through a path from the input electrode to the output electrode of the first pixel switching element T1 may be determined from the following Equation 1.

$$ISD = \frac{1}{2}\mu Cox\frac{W}{L}(VSG - |VTH|)^2 \quad \text{Equation 1}$$

In Equation 1, μ a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the absolute value of the threshold voltage (VTH) of the first pixel switching element T1.

The voltage VG of the first node N1 after the compensation of the threshold voltage (VTH) during the second duration DU2 may be represented by the following Equation 2.

$$VG = VDATA - |VTH| \quad \text{Equation 2:}$$

When the organic light emitting diode OLED emits the light during the fourth duration DU4, the driving voltage VOV and the driving current ISD may be represented by the following Equations 3 and 4.

$$VOV = VS - VG - |VTH| = ELVDD - (VDATA - |VTH|) - |VTH| = ELVDD - VDATA \quad \text{Equation 3}$$

$$ISD = \frac{1}{2}\mu Cox\frac{W}{L}(ELVDD - VDATA)^2 \quad \text{Equation 4}$$

In Equation 3, VS is a voltage of the second node N2.

The threshold voltage (VTH) is compensated during the second duration DU2, so that the driving current ISD may be determined regardless of the threshold voltage (VTH) of the first pixel switching element T1 when the organic light emitting diode OLED emits the light during the fourth duration DU4.

Figure 7:
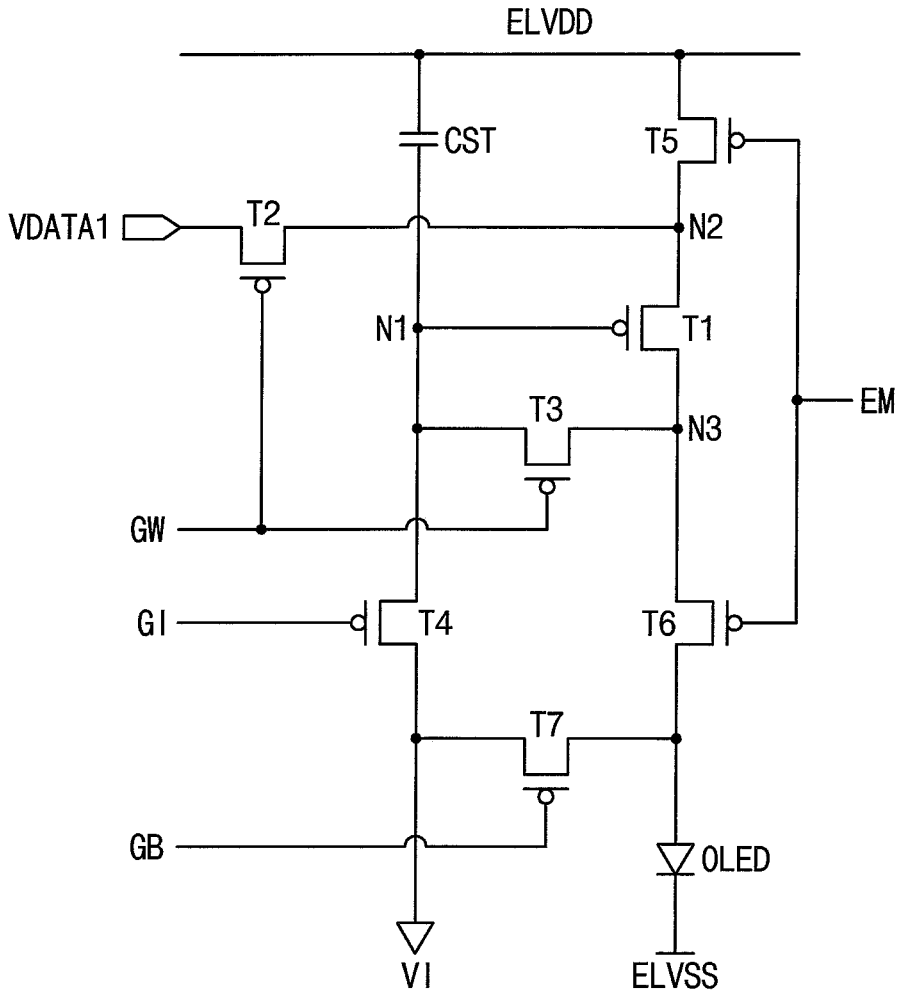
FIG. 7 is a circuit diagram illustrating a subpixel of the first display area of FIG. 2.
Figure 8:
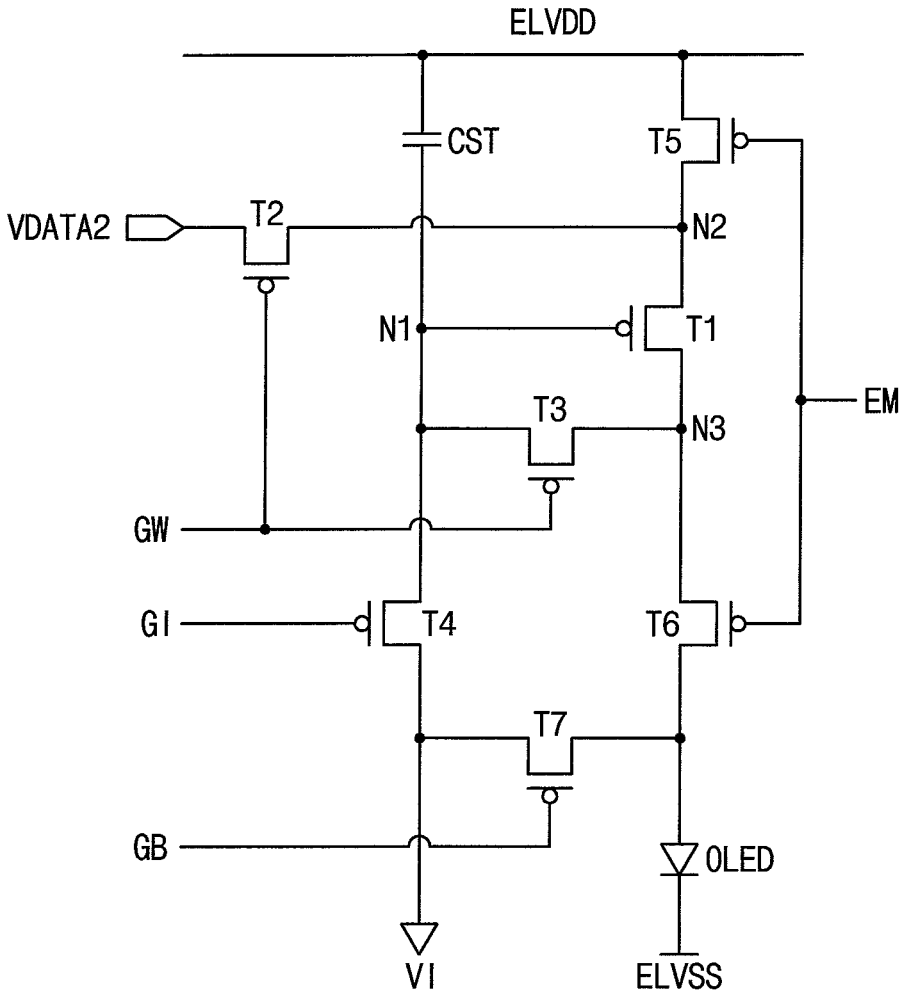
FIG. 8 is a circuit diagram illustrating a subpixel of a second display area of FIG. 2.
Figure 9:
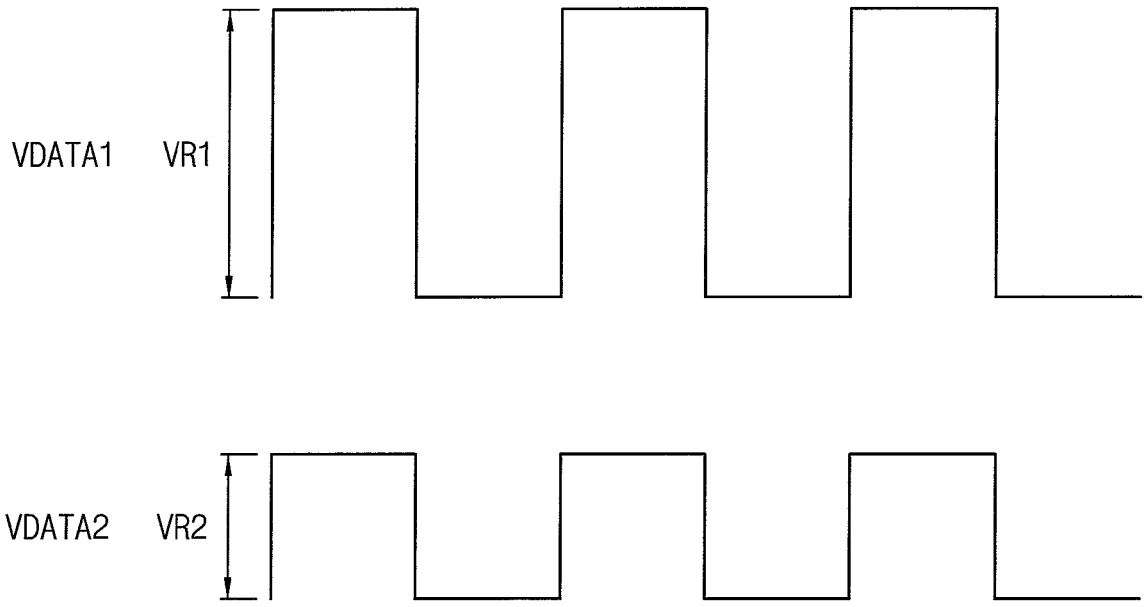
FIG. 9 is a timing diagram illustrating a data voltage applied to the subpixel of the first display area of FIG. 7, and a data voltage applied to the subpixel of the second display area of FIG. 8.

FIG. 7 is a circuit diagram illustrating the subpixel of the first display area A1 of FIG. 2. FIG. 8 is a circuit diagram illustrating the subpixel of the second display area A2 of FIG. 2. FIG. 9 is a timing diagram illustrating a data voltage VDATA1 applied to the subpixel of the first display area A1 of FIG. 7, and a data voltage VDATA2 applied to the subpixel of the second display area A2 of FIG. 8.

Referring to FIGS. 1 to 9, the display panel driver may control a driving signal of the first display area A1 and a driving signal of the second display area A2 according to the ratio between the pixel area PA and the non-pixel area TA of the first display are A1 of the display panel 100.

For example, if the first display area A1 includes the pixel area PA and the non-pixel area TA (e.g., includes only the pixel area PA and the non-pixel area TA), and the ratio between the pixel area PA and the non-pixel area TA at (e.g., in or on) the first display area A1 is 1:1, the number of the pixel areas PA of the first display area A1 for a unit area (e.g., a particular area of the first display area A1 having a size) may be half of the number of the pixel areas PA of the second display area A2 for the unit area (e.g., a particular area of the second display area A2 having the same or substantially the same size as that of the particular area of the first display area A1). Thus, when the first display area A1 and the second display area A2 are driven by a same driving signal, the luminance of the first display area A1 may be half of the luminance of the second display area A2.

In the present exemplary embodiment, the first data voltage VDATA1 may be applied to the input electrode of the second pixel switching element T2 of the subpixel of the first display area A1, and the second data voltage VDATA2 that is different from the first data voltage VDATA1 may be applied to the input electrode of the second pixel switching element T2 of the subpixel of the second display area A2. Accordingly, in the present exemplary embodiment, the display area A1 and the second display area A2 may be driven by different driving signals (e.g., VDATA1 and VDATA2), such that a difference between the luminance of the first display area A1 and the luminance of the second display area A2 may be reduced or minimized.

For example, the display panel driver may generate a minimum data voltage corresponding to a minimum grayscale value (e.g., a minimum grayscale level) of the input image data IMG, and a maximum data voltage corresponding to a maximum grayscale value (e.g., a maximum grayscale level) of the input image data IMG. In this case, a difference VR1 between the maximum data voltage and the minimum data voltage of the first display area A1 may be greater than a difference VR2 between the maximum data voltage and the minimum data voltage of the second display area A2. The data voltage VDATA (e.g., VDATA1 and VDATA2) may be generated based on the input image data IMG by the driving controller 200 and the data driver 500 of the display panel driver.

When the ratio between the pixel area PA at (e.g., in or on) the first display area A1 and the sum of the pixel area PA and the non-pixel area TA at (e.g., in or on) the first display area A1 is 1/N (where N is a natural number), the difference VR1 between the maximum voltage data and the minimum voltage data of the first display area A1 may be greater than the difference VR2 between the maximum voltage data and the minimum voltage data of the second display area A2 by N times (e.g., by a factor of N). For example, in the present exemplary embodiment, N may be equal to two.

Thus, the luminance of the first display area A1 having a reduced luminance due to the non-pixel area TA may be increased, so that the difference between the luminance of the first display area A1 and the luminance of the second display area A2 may be compensated.

For example, according to the present exemplary embodiment, the difference between the luminance of the first display area A1 of the display panel 100 corresponding to the first area B1 of the sensor substrate 800 and the luminance of the second display area A2 of the display panel 100 corresponding to the second area B2 of the sensor substrate 800 may be reduced, so that the display quality of the display panel 100 may be improved or enhanced.

Figure 10:
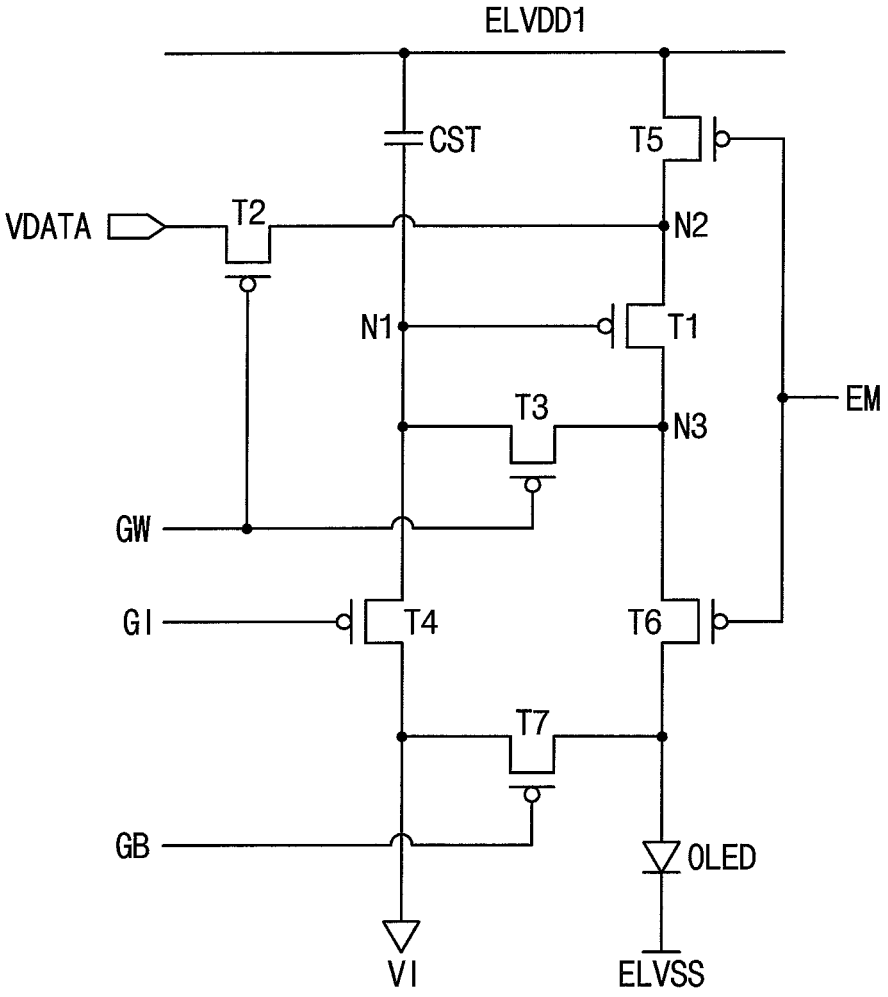
FIG. 10 is a circuit diagram illustrating a subpixel of a first display area of a display panel according to an exemplary embodiment of the present disclosure.
Figure 11:
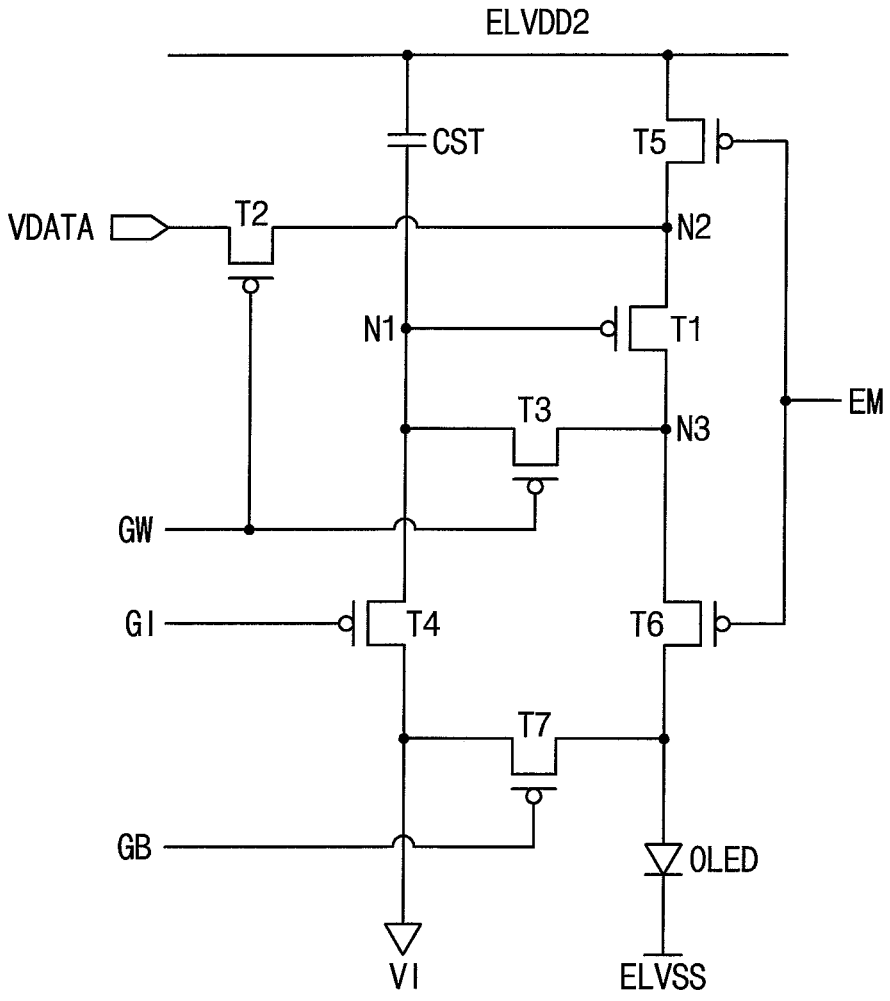
FIG. 11 is a circuit diagram illustrating a subpixel of a second display area of the display panel corresponding to that of FIG. 10 according to an exemplary embodiment of the present disclosure.

FIG. 10 is a circuit diagram illustrating a subpixel of a first display area A1 of a display panel 100 according to an exemplary embodiment of the present disclosure. FIG. 11 is a circuit diagram illustrating a subpixel of a second display area A2 of the display panel 100 corresponding to that of FIG. 10 according to an exemplary embodiment of the present disclosure.

The display apparatus and the method of driving the display apparatus according to the present exemplary embodiment may be the same or substantially the same as the display apparatus and the method of driving the display apparatus of one or more of the exemplary embodiments described above with reference FIGS. 1 to 9, except that a method of compensating the difference between the luminance of the first display area and the luminance of the second display area may be different. Thus, the same or substantially the same reference symbols may be used to refer to the same or substantially the same (e.g., like or similar) parts as those described above with reference to one or more of the exemplary embodiments of FIGS. 1 to 9, and thus, redundant descriptions thereof may be simplified or may not be repeated.

Referring to FIGS. 1 to 6, 10, and 11, the display apparatus includes a display panel 100 and a display panel driver. The display panel driver includes a driving controller 200, a gate driver 300, a gamma reference voltage generator 400, a data driver 500, and an emission driver 600. The display panel driver may further include a power voltage generator 700. The display apparatus may further include a sensor substrate 800.

The display panel 100 may include a first display area A1 and a second display area A2. The sensor substrate 800 may include a first area B1 and a second area B2.

The sensors SS may be disposed at (e.g., in or on) the first area B1 of the sensor substrate 800. The sensors SS may not be disposed at (e.g., in or on) the second area B2 of the sensor substrate 800.

The first display area A1 of the display panel 100 may correspond to the first area B1 of the sensor substrate 800. For example, the first display area A1 of the display panel 100 may overlap with the first area B1 of the sensor substrate 800.

The second display area A2 of the display panel 100 may correspond to the second area B2 of the sensor substrate 800. For example, the second display area A2 of the display panel 100 may overlap with the second area B2 of the sensor substrate 800.

The first display area A1 may include a pixel area (e.g., a plurality of pixel areas) PA and a non-pixel area (e.g., a plurality of non-pixel areas) TA. At least one subpixel may be disposed at (e.g., in or on) the pixel area (e.g., at each of the pixel areas) PA. The second display area A2 may correspond to the second area B2 of the sensor substrate 800 at (e.g., in or on) which the sensor SS is not disposed, so that the second display area A2 may include the pixel area PA without including the non-pixel area TA (e.g., may include only the pixel areas PA).

The display panel driver may control a driving signal of the first display area A1 and a driving signal of the second display area A2 according to the ratio between the pixel area PA and the non-pixel area TA of the first display area A1 of the display panel 100.

For example, if the first display area A1 includes the pixel area PA and the non-pixel area TA (e.g., only the pixel area PA and the non-pixel area TA), and the ratio between the pixel area PA and the non-pixel area TA at (e.g., in or on) the first display area A1 is 1:1, the number of the pixel areas PA of the first display area A1 for a unit area (e.g., a particular area of the first display area A1 having a size) may be half of the number of the pixel areas PA of the second display area A2 for the unit area (e.g., a particular area of the second display area A2 having the same or substantially the same size as that of the particular area of the first display area A1). Thus, when the first display area A1 and the second display area A2 are driven by a same driving signal, the luminance of the first display area A1 may be half of the luminance of the second display area A2.

In the present exemplary embodiment, a first power voltage ELVDD1 may be applied to an input electrode of the fifth pixel switching element T5 of the subpixel of the first display area A1. A second power voltage ELVDD2 that is different from the first power voltage ELVDD1 may be applied to an input electrode of the fifth pixel switching element T5 of the subpixel of the second display area A2. In this case, the first power voltage ELVDD1 may be greater than the second power voltage ELVDD2. The first power voltage ELVDD1 and the second power voltage ELVDD2 may be applied to the subpixels of the first display area A1 and the second display area A2, respectively, by the power voltage generator 700.

When the ratio between the pixel area PA at (e.g., in or on) the first display area A1 and the sum of the pixel area PA and the non-pixel area TA at (e.g., in or on) the first display area A1 is 1/N (where N is a natural number), the first power voltage ELVDD1 may be greater than the second power voltage ELVDD2 by N times (e.g., by a factor of N). For example, in the present exemplary embodiment, N may be equal to two. The first power voltage ELVDD1 may be the high power voltage applied to the subpixels of the first display area A1, and the second power voltage ELVDD2 may be the high power voltage applied to the subpixels of the second display area A2. In the present exemplary embodiment, the low power voltage ELVSS applied to the subpixels of the first display area A1 may be same or substantially the same as the low power voltage ELVSS applied to the subpixels of the second display area A2.

Thus, the luminance of the first display area A1 having a reduced luminance due to the non-pixel area TA may be increased, so that the difference between the luminance of the first display area A1 and the luminance of the second display area A2 may be compensated.

According to the present exemplary embodiment, the difference between the luminance of the first display area A1 of the display panel 100 corresponding to the first area B1 of the sensor substrate 800 and the luminance of the second display area A2 of the display panel 100 corresponding to the second area B2 of the sensor substrate 800 may be reduced, so that the display quality of the display panel 100 may be improved or enhanced.

Figure 12:
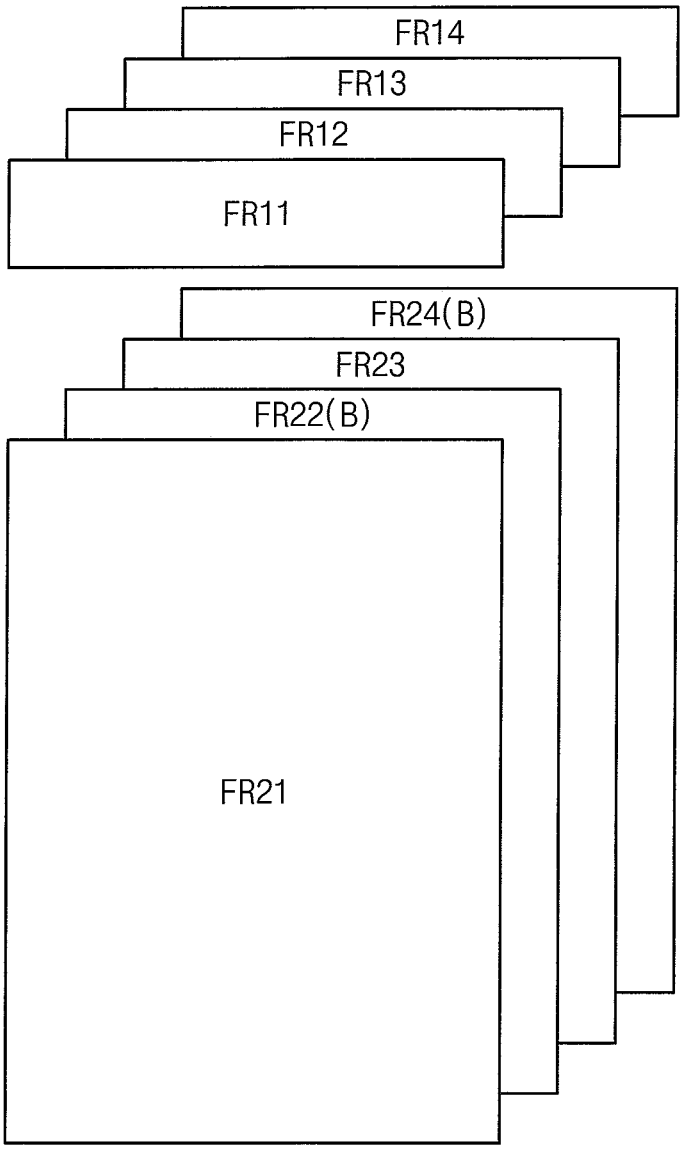
FIG. 12 is a conceptual diagram illustrating frame images of the first display area of a display panel disclosure and frame images of the second display area of the display panel, according to an exemplary embodiment of the present disclosure.

FIG. 12 is a conceptual diagram illustrating frame images of the first display area A1 of the display panel 100 disclosure and frame images of the second display area A2 of the display panel 100, according to an exemplary embodiment of the present disclosure.

The display apparatus and the method of driving the display apparatus according to the present exemplary embodiment may be the same or substantially the same as the display apparatus and the method of driving the display apparatus of one or more of the exemplary embodiments described above with reference to FIGS. 1 to 9, except that a method of compensating the difference between the luminance of the first display area and the luminance of the second display area may be different. Thus, the same or substantially the same reference symbols may be used to refer to the same or substantially the same (e.g., like or similar) parts as those described above with reference to one or more of the exemplary embodiments of FIGS. 1 to 9, and thus, redundant descriptions thereof may be simplified or may not be repeated.

Referring to FIGS. 1 to 6 and 12, the display apparatus includes a display panel 100 and a display panel driver. The display panel driver includes a driving controller 200, a gate driver 300, a gamma reference voltage generator 400, a data driver 500, and an emission driver 600. The display panel driver may further include a power voltage generator 700. The display apparatus may further include a sensor substrate 800.

The display panel 100 may include a first display area A1 and a second display area A2. The sensor substrate 800 may include a first area B1 and a second area B2.

The sensors SS may be disposed at (e.g., in or on) the first area B1 of the sensor substrate 800. The sensors SS may not be disposed at (e.g., in or on) the second area B2 of the sensor substrate 800.

The first display area A1 of the display panel 100 may correspond to the first area B1 of the sensor substrate 800. For example, the first display area A1 of the display panel 100 may overlap with the first area B1 of the sensor substrate 800.

The second display area A2 of the display panel 100 may correspond to the second area B2 of the sensor substrate 800. For example, the second display area A2 of the display panel 100 may overlap with the second area B2 of the sensor substrate 800.

The first display area A1 may include a pixel area (e.g., a plurality of pixel areas) PA and a non-pixel area (e.g., a plurality of non-pixel areas) TA. At least one subpixel may be disposed at (e.g., in or on) the pixel area (e.g., at each of the pixel areas) PA. The second display area A2 may correspond to the second area B2 of the sensor substrate 800 at (e.g., in or on) which the sensor SS is not disposed, so that the second display area A2 may include the pixel area PA but not the non-pixel area TA (e.g., may include only the pixel area PA).

The display panel driver may control a driving signal of the first display area A1 and a driving signal of the second display area A2 according to the ratio between the pixel area PA and the non-pixel area TA of the first display area A1 of the display panel 100.

For example, if the first display area A1 includes the pixel area PA and the non-pixel area TA (e.g., includes only the pixel area PA and the non-pixel area TA), and the ratio between the pixel area PA and the non-pixel area TA at (e.g., in or on) the first display area A1 is 1:1, the number of the pixel areas PA of the first display area A1 for a unit area (e.g., a particular area of the first display area A1 having a size) may be half of the number of the pixel areas PA of the second display area A2 for the unit area (e.g., a particular area of the second display area A2 having a size that is the same or substantially the same as that of the particular area of the first display area A1). Thus, when the first display area A1 and the second display area A2 are driven by a same driving signal, the luminance of the first display area A1 may be half of the luminance of the second display area A2.

In the present exemplary embodiment, the display panel driver may provide one or more first normal image frames FR11, FR12, FR13, and FR14 based on the input image data IMG to the first display area A1. The display panel driver may provide one or more second normal image frames FR21 and FR23 based on the input image data IMG, and one or more black image frames FR22(B) and FR24(B) to the second display area A2. The black image frames FR22(B) and FR24(B) may represent a solid black image, and may be generated regardless of the input image data IMG.

When the first display area A1 displays the first normal image frames FR11, FR12, FR13, and FR14 that are generated based on the input image data IMG at (e.g., in) a first driving frequency (e.g. 120 Hz), the second display area A2 displays the second normal image frames FR21 and FR23 that are generated based on the input image data IMG at (e.g., in) a second driving frequency (e.g. 60 Hz) that is less than the first driving frequency (e.g. 120 Hz). The black image frames FR22(B) and FR24(B) may be inserted between the second normal image frames FR21 and FR23, so that the luminance of the second display area A2 may be reduced compared to the luminance of the first display area A1.

When a ratio between the pixel area PA of the first display area A1 and the sum of the pixel area PA and the non-pixel area TA of the first display area A1 is x:y (e.g., 1:2 in FIG. 4A), a ratio between the number of the second normal frames of the second display area A2 and the number of the first normal frames of the first display area A1 may be x:y. For example, in the present exemplary embodiment, the ratio x:y may be 1:2.

Thus, the luminance of the second display area A2 having a relatively higher luminance than that of the first display area A1 due to not including the non-pixel area TA may be reduced, so that the difference between the luminance of the first display area A1 and the luminance of the second display area A2 may be compensated.

For example, according to the present exemplary embodiment, the difference between the luminance of the first display area A1 of the display panel 100 corresponding to the first area B1 of the sensor substrate 800 and the luminance of the second display area A2 of the display panel 100 corresponding to the second area B2 of the sensor substrate 800 may be reduced, so that the display quality of the display panel 100 may be improved or enhanced.

Figure 13:
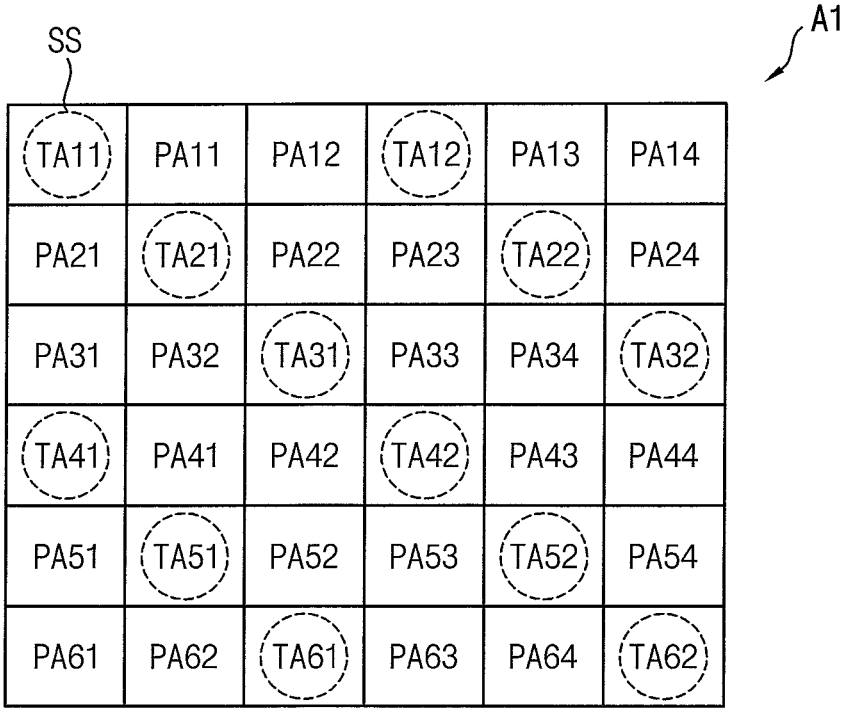
FIG. 13 is a conceptual diagram illustrating an example of a position relationship between a first display area of a display panel of a display apparatus and a sensor according to an exemplary embodiment of the present disclosure.

FIG. 13 is a conceptual diagram illustrating an example of a position relationship between a first display area of a display panel 100 of a display apparatus disclosure and a sensor SS according to an exemplary embodiment of the present disclosure.

The display apparatus and the method of driving the display apparatus according to the present exemplary embodiment may be the same or substantially the same as the display apparatus and the method of driving the display apparatus of one or more exemplary embodiments described with reference to FIGS. 1 to 12, except that a ratio between the pixel area and the non-pixel area at (e.g., in or on) the first pixel area may be different. Thus, the same or substantially the same reference symbols may be used to refer to the same or substantially the same (e.g., like or similar) parts as those described above with reference to the one or more exemplary embodiments of FIGS. 1 to 12, and thus, redundant description thereof may be simplified or may not be repeated.

Referring to FIGS. 1 to 3 and 5 to 13, the display apparatus includes a display panel 100 and a display panel driver. The display panel driver includes a driving controller 200, a gate driver 300, a gamma reference voltage generator 400, a data driver 500, and an emission driver 600. The display panel driver may further include a power voltage generator 700. The display apparatus may further include a sensor substrate 800.

The display panel 100 may include a first display area A1 and a second display area A2. The sensor substrate 800 may include a first area B1 and a second area B2.

The sensors SS may be disposed at (e.g., in or on) the first area B1 of the sensor substrate 800. The sensors SS may not be disposed at (e.g., in or on) the second area B2 of the sensor substrate 800.

The first display area A1 of the display panel 100 may correspond to the first area B1 of the sensor substrate 800. For example, the first display area A1 of the display panel 100 may overlap with the first area B1 of the sensor substrate 800.

The second display area A2 of the display panel 100 may correspond to the second area B2 of the sensor substrate 800. For example, the second display area A2 of the display panel 100 may overlap with the second area B2 of the sensor substrate 800.

The first display area A1 may include a pixel area (e.g., a plurality of pixel areas) PA and a non-pixel area (e.g., a plurality of non-pixel areas) TA. At least one subpixel may be disposed at (e.g., in or on) the pixel area (e.g., at each of the pixel areas) PA. The second display area A2 may correspond to the second area B2 of the sensor substrate 800 at (e.g., in or on) which the sensor SS is not disposed, so that the second display area A2 may include the pixel area PA but not the non-pixel area TA (e.g., may include only the pixel area PA).

The display panel driver may control a driving signal of the first display area A1 and a driving signal of the second display area A2 according to the ratio between the pixel area PA and the non-pixel area TA of the first display are A1 of the display panel 100.

For example, if the first display area A1 includes the pixel area PA and the non-pixel area TA (e.g., includes only the pixel area PA and the non-pixel area TA), and the ratio between the pixel area PA and the non-pixel area TA at (e.g., in or on) the first display area A1 is 2:1, the number of the pixel areas PA of the first display area A1 at (e.g., in or on) a unit area (e.g., a particular area of the first display area A1 having a size) may be ⅔ of the number of the pixel areas PA of the second display area A2 at (e.g., in or on) the unit area (e.g., a particular area of the second display area A2 having the same or substantially the same size as that of the particular area of the first display area A1). Thus, when the first display area A1 and the second display area A2 are driven by a same driving signal, the luminance of the first display area A1 may be ⅔ of the luminance of the second display area A2.

As described with reference to FIGS. 7 to 9, in the present exemplary embodiment, a first data voltage VDATA1 may be applied to the input electrode of the second pixel switching element T2 of the subpixel of the first display area A1, and a second data voltage VDATA2 that is different from the first data voltage VDATA1 may be applied to the input electrode of the second pixel switching element T2 of the subpixel of the second display area A2.

The display panel driver may generate a minimum data voltage corresponding to a minimum grayscale value (or a minimum grayscale level) of the input image data IMG and a maximum data voltage corresponding to a maximum grayscale value (or a maximum grayscale level) of the input image data IMG. In this case, a difference VR1 between the maximum data voltage and the minimum data voltage of the first display area A1 may be greater than a difference VR2 between the maximum data voltage and the minimum data voltage of the second display area A2. The data voltage VDATA (e.g., VDATA1 and VDATA2) may be generated based on the input image data IMG by the driving controller 200 and the data driver 500 of the display panel driver.

When the ratio between the pixel area PA at (e.g., in or on) the first display area A1 and the sum of the pixel area PA and the non-pixel area TA at (e.g., in or on) the first display area A1 is 1/N (where N is a natural number), the difference VR1 between the maximum voltage data and the minimum voltage data of the first display area A1 may be greater than the difference VR2 between the maximum voltage data and the minimum voltage data of the second display area A2 by N times (e.g., by a factor of N). For example, in the present exemplary embodiment, N may be equal to 1.5.

In addition, as described with reference to FIGS. 10 and 11, in the present exemplary embodiment, a first power voltage ELVDD1 may be applied to an input electrode of the fifth pixel switching element T5 of the subpixel of the first display area A1, and a second power voltage ELVDD2 that is different from the first power voltage ELVDD1 may be applied to an input electrode of the fifth pixel switching element T5 of the subpixel of the second display area A2. For example, the first power voltage ELVDD1 may be greater than the second power voltage ELVDD2. The first power voltage ELVDD1 and the second power voltage ELVDD2 may be applied to the pixel by the power voltage generator 700.

When the ratio between the pixel area PA at (e.g., in or on) the first display area A1 and the sum of the pixel area PA and the non-pixel area TA at (e.g., in or on) the first display area A1 is 1/N (where N is a natural number), the first power voltage ELVDD1 may be greater than the second power voltage ELVDD2 by N times (e.g., by a factor of N). For example, in the present exemplary embodiment, N may be equal to 1.5. In the present exemplary embodiment, the low power voltage ELVSS that is applied to the subpixels of the first display area A1 may be same or substantially the same as the low power voltage ELVSS that is applied to the subpixels of the second display area A2.

Thus, the luminance of the first display area A1 having a reduced luminance due to the non-pixel area TA may be increased so that the difference between the luminance of the first display area A1 and the luminance of the second display area A2 may be compensated.

Figure 14:
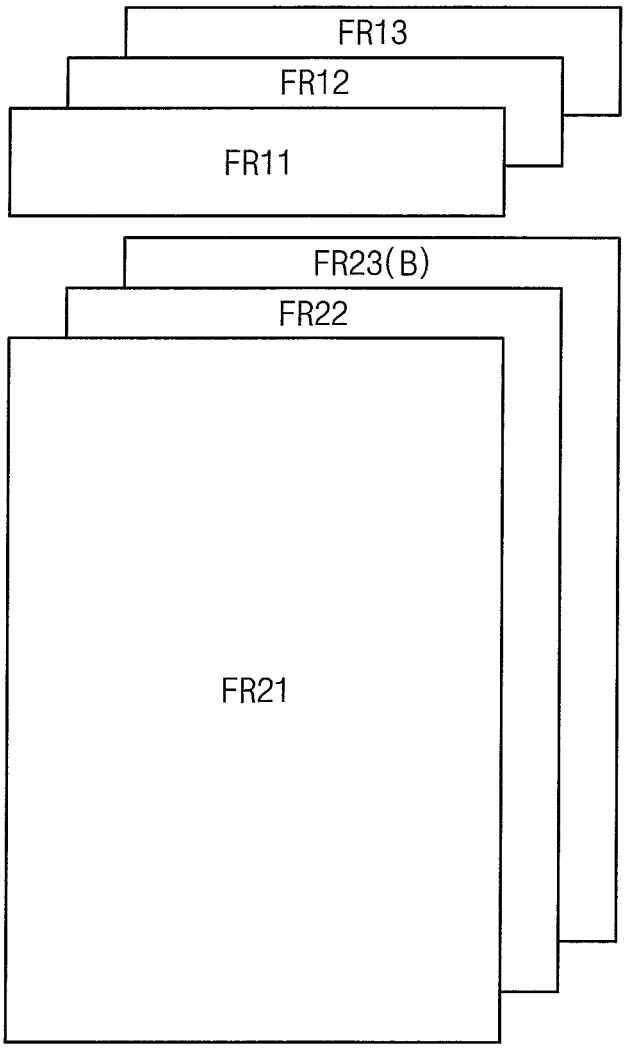
FIG. 14 is a conceptual diagram illustrating frame images of the first display area of the display panel of FIG. 13, and frame images of the second display area of the display panel.

FIG. 14 is a conceptual diagram illustrating frame images of the first display area of the display panel of FIG. 13, and frame images of the second display area of the display panel.

Referring to FIGS. 1 to 3 and 5 to 14, in the present exemplary embodiment, the display panel driver may provide one or more first normal image frames FR11, FR12 and FR13 based on the input image data IMG to the first display area A1. The display panel driver may provide one or more of second normal image frames FR21 and FR22 based on the input image data IMG, and a black image frame FR23(B) to the second display area A2.

When a ratio between the pixel area PA of the first display area A1 and the sum of the pixel area PA and the non-pixel area TA of the first display area A1 is x:y (e.g., 2:3 in FIG. 13), a ratio between the number of the second normal frames of the second display area A2 and the number of the first normal frames of the first display area A1 may be x:y. For example, in the present exemplary embodiment, the ratio x:y may be 2:3.

Thus, the luminance of the second display area A2 having a relatively higher luminance than that of the first display area A1 due to not including the non-pixel area TA may be reduced, so that the difference between the luminance of the first display area A1 and the luminance of the second display area A2 may be compensated.

According to the present exemplary embodiment, the difference between the luminance of the first display area A1 of the display panel 100 corresponding to the first area B1 of the sensor substrate 800 and the luminance of the second display area A2 of the display panel 100 corresponding to the second area B2 of the sensor substrate 800 may be reduced, so that the display quality of the display panel 100 may be improved or enhanced.

According to one or more of the exemplary embodiments of the present disclosure as described above, the display quality of the display panel of the display apparatus including the sensor may be improved or enhanced.

The foregoing is illustrative of the present disclosure and is not to be construed as limiting thereof. Although a few exemplary embodiments of the present disclosure have been described, those skilled in the art will readily appreciate that various modifications may be possible in the exemplary embodiments without departing from the spirit and scope of the present disclosure. Accordingly, all such modifications are intended to be included within the scope of the present disclosure as defined in the claims. In the claims, means-plus-function clauses, if any, are intended to cover the structures described herein as performing the recited function and not only structural equivalents but also equivalent structures. Therefore, it is to be understood that the foregoing is illustrative of the present disclosure and is not to be construed as limited to any particular exemplary embodiments disclosed herein, and that various modifications to the disclosed exemplary embodiments, as well as other exemplary embodiments, are intended to be included within the scope of the appended claims. The present disclosure is defined by the following claims and their equivalents.

What is claimed is:

1. A display apparatus comprising:

a sensor substrate comprising a first area and a second area;

a plurality of sensors at the first area and not at the second area;

a display panel on the sensor substrate, the display panel comprising a first display area corresponding to the first area, and a second display area corresponding to the second area, the first display area comprising a pixel area and a non-pixel area;

at least one subpixel at the pixel area and no subpixels at the non-pixel area; and a display panel driver configured to control a luminance of the first display area and a luminance of the second display area to reduce a difference in the luminances between the first and second display areas according to a ratio between the pixel area of the first display area and the non-pixel area of the first display area.

2. The display apparatus of claim 1, wherein the display panel driver is configured to generate:

a minimum data voltage corresponding to a minimum grayscale value of input image data corresponding to the first display area;

a maximum data voltage corresponding to a maximum grayscale value of the input image data corresponding to the first display area;

a minimum data voltage corresponding to a minimum grayscale value of the input image data corresponding to the second display area; and a maximum data voltage corresponding to a maximum grayscale value of the input image data corresponding to the second display area, and wherein a difference between the maximum data voltage and the minimum data voltage of the input image data corresponding to the first display area is greater than a difference between the maximum data voltage and the minimum data voltage of the input image data corresponding to the second display area.

3. The display apparatus of claim 2, wherein when a ratio between the pixel area at the first display area and a sum of the pixel area and the non-pixel area at the first display area is 1/N, the difference between the maximum data voltage and the minimum data voltage of the input image data corresponding to the first display area is greater than the difference between the maximum data voltage and the minimum data voltage of the input image data corresponding to the second display area by N times.

4. The display apparatus of claim 1, wherein the display panel driver is configured to provide:

a first power voltage to a subpixel circuit of the first display area; and a second power voltage to a subpixel circuit of the second display area, and wherein the first power voltage is greater than the second power voltage.

5. The display apparatus of claim 4, wherein when a ratio between the pixel area at the first display area and a sum of the pixel area and the non-pixel area at the first display area is 1/N, the first power voltage is greater than the second power voltage by N times.

6. The display apparatus of claim 4, wherein the subpixel comprises an organic light emitting diode, wherein the subpixel is configured to receive a data write gate signal, a data initialization gate signal, an organic light emitting diode initialization signal, a data voltage, and an emission signal, and wherein the organic light emitting diode of the subpixel is configured to emit light corresponding to a level of the data voltage to display an image.

7. The display apparatus of claim 1, wherein the display panel driver is configured to provide a first normal image frame according to input image data to the first display area, and wherein the display panel driver is configured to provide a second normal image frame according to the input image data, and a black frame image to the second display area.

8. The display apparatus of claim 7, wherein when a ratio between the pixel area of the first display area and a sum of the pixel area and the non-pixel area of the first display area is x:y, a ratio between a number of the second normal frames of the second display area and a number of the first normal frames of the first display area is x:y.

9. The display apparatus of claim 1, wherein the plurality of sensors comprises an infrared sensor.

10. The display apparatus of claim 9, wherein the plurality of the sensors are configured to recognize a face of a user.

11. The display apparatus of claim 1, wherein a size of the pixel area at the first display area is the same as a size of the non-pixel area at the first display area.

12. The display apparatus of claim 11, wherein the pixel area at the first display area comprises a plurality of pixel areas, and each of the plurality of pixel areas comprises a single subpixel.

13. The display apparatus of claim 11, wherein the pixel area at the first display area comprises a plurality of pixel areas, and each of the pixel areas comprises a single pixel, the single pixel comprising a plurality of subpixels.

14. The display apparatus of claim 1, wherein the non-pixel area comprises a plurality of non-pixel areas, and each single sensor from among the plurality of sensors overlaps with a corresponding one of the non-pixel areas.

15. The display apparatus of claim 1, wherein the non-pixel area comprises a plurality of non-pixel areas, and each single sensor from among the plurality of sensors overlaps with a plurality of corresponding ones of the non-pixel areas.

16. A display apparatus comprising:

a sensor substrate comprising a first area and a second area;

a plurality of sensors at the first area and not at the second area;

a display panel on the sensor substrate, the display panel comprising a first display area corresponding to the first area, and a second display area corresponding to the second area, the first display area comprising a pixel area and a non-pixel area;

at least one subpixel at the pixel area and no subpixels at the non-pixel area; and a display panel driver configured to control a luminance of the first display area and a luminance of the second display area according to a ratio between the pixel area of the first display area and the non-pixel area of the first display area, wherein the display panel driver is configured to provide:

a first power voltage to a subpixel circuit of the first display area; and a second power voltage to a subpixel circuit of the second display area, wherein the first power voltage is greater than the second power voltage, wherein the subpixel comprises an organic light emitting diode, wherein the subpixel is configured to receive a data write gate signal, a data initialization gate signal, an organic light emitting diode initialization signal, a data voltage, and an emission signal, wherein the organic light emitting diode of the subpixel is configured to emit light corresponding to a level of the data voltage to display an image, wherein the subpixel further comprises:

a first pixel switching element comprising a control electrode connected to a first node, an input electrode connected to a second node, and an output electrode connected to a third node;

a second pixel switching element comprising a control electrode to receive the data write gate signal, an input electrode to receive the data voltage, and an output electrode connected to the second node;

a third pixel switching element comprising a control electrode to receive the data write gate signal, an input electrode connected to the first node, and an output electrode connected to the third node;

a fourth pixel switching element comprising a control electrode to receive the data initialization gate signal, an input electrode to receive an initialization voltage, and an output electrode connected to the first node;

a fifth pixel switching element comprising a control electrode to receive the emission signal, an input electrode to receive a high power voltage, and an output electrode connected to the second node;

a sixth pixel switching element comprising a control electrode to receive the emission signal, an input electrode connected to the third node, and an output electrode connected to an anode electrode of the organic light emitting diode;

a seventh pixel switching element comprising a control electrode to receive the organic light emitting diode initialization signal, an input electrode to receive the initialization voltage, and an output electrode connected to the anode electrode of the organic light emitting diode; and a storage capacitor comprising a first electrode to receive the high power voltage, and a second electrode connected to the first node, and wherein the organic light emitting diode comprises the anode electrode, and a cathode electrode to receive a low power voltage.

17. The display apparatus of claim 16, wherein the input electrode of the fifth pixel switching element of the subpixel at the first display area is configured to receive the first power voltage, wherein another subpixel is at the second display area, and wherein an input electrode of a fifth pixel switching element of the other subpixel at the second display area is configured to receive the second power voltage.

18. A method of driving a display apparatus, the method comprising:

sensing a user using a sensor substrate, the sensor substrate comprising a first area, a second area, and a plurality of sensors at the first area and not at the second area;

providing a driving signal to a first display area of a display panel corresponding to the first area, the first display area comprising a pixel area, a non-pixel area, and at least one subpixel at the pixel area and no subpixels at the non-pixel area; and providing a driving signal to a second display area of the display panel corresponding to the second area;

wherein a display panel driver is configured to control a luminance of the first display area and a luminance of the second display area to reduce a difference in the luminances between the first and second display areas according to a ratio between the pixel area of the first display area and the non-pixel area of the first display area.

19. The method of claim 18, wherein the display panel driver is configured to generate:

a minimum data voltage corresponding to a minimum grayscale value of input image data corresponding to the first display area;

a maximum data voltage corresponding to a maximum grayscale value of the input image data corresponding to the first display area;

a minimum data voltage corresponding to a minimum grayscale value of the input image data corresponding to the second display area; and a maximum data voltage corresponding to a maximum grayscale value of the input image data corresponding to the second display area, and wherein a difference between the maximum data voltage and the minimum data voltage of the input image data corresponding to the first display area is greater than a difference between the maximum data voltage and the minimum data voltage of the input image data corresponding to the second display area.

20. The method of claim 18, wherein the display panel driver is configured to provide:

a first power voltage to a subpixel circuit of the first display area; and a second power voltage to a subpixel circuit of the second display area, and wherein the first power voltage is greater than the second power voltage.

* * * * *